US010258815B1

(12) United States Patent
Reiman et al.

(10) Patent No.: US 10,258,815 B1
(45) Date of Patent: Apr. 16, 2019

(54) COLLAPSIBLE COOKING OIL FIRE EXTINGUISHING DEVICE

(71) Applicants: Hannu Juhani Reiman, Punta Gorda, FL (US); Urho Hämälainen, Helsinki (FI)

(72) Inventors: Hannu Juhani Reiman, Punta Gorda, FL (US); Urho Hämälainen, Helsinki (FI)

( * ) Notice: Subject to any disclaimer, the term of this patent is extended or adjusted under 35 U.S.C. 154(b) by 0 days.

(21) Appl. No.: 15/827,685

(22) Filed: Nov. 30, 2017

(51) Int. Cl.
*A62C 3/00* (2006.01)
*A62C 8/06* (2006.01)

(52) U.S. Cl.
CPC ..... *A62C 8/06* (2013.01); *A62C 3/006* (2013.01)

(58) Field of Classification Search
CPC .. A62C 2/06; A62C 2/10; A62C 3/006; A62C 8/06
See application file for complete search history.

(56) References Cited

U.S. PATENT DOCUMENTS 3,283,826 A * 11/1966 Padellford ..... A62C 8/08 169/49
4,602,611 A * 7/1986 Hankey ..... A47J 37/108 126/373.1
5,842,525 A 12/1998 Graham
2007/0158084 A1* 7/2007 Schwartz ..... A62C 8/06 169/30

FOREIGN PATENT DOCUMENTS

DE 2942247 A1 * 4/1981 ..... A62C 3/006
GB 2298574 A * 9/1996 ..... A62C 8/06
JP 10033706 A * 2/1998 ..... A62C 3/006

* cited by examiner

*Primary Examiner* — Ryan A Reis
(74) *Attorney, Agent, or Firm* — McHale & Slavin, P.A.

(57) ABSTRACT

A collapsible cooking oil fire extinguishing device having a shaft with two rigid support arms for support of a fire resistant material. An automatic locking mechanism with a manual pivot mechanism enables changing the device between a collapsed storage position and an expanded usage position. The rigid support arms extend only partially around the perimeter of the fire resistant material, which enables the fire resistant material to tightly cover a cooking oil fire in a vessel with a handle. The pivot mechanism, automatic locking means, and rigid support arms allow the user to exert downward pressure on the burning vessel, thereby creating an airtight seal, cutting off the supply of oxygen and extinguishing the fire. The spring in the automatic locking mechanism is not under compression in the storage position, which increases reliability and prevents malfunction during long periods of time in the storage position.

19 Claims, 8 Drawing Sheets

COLLAPSIBLE COOKING OIL FIRE EXTINGUISHING DEVICE

FIELD OF THE INVENTION

This invention is related to the field of fire extinguishing and in particular to a collapsible cooking oil fire extinguishing device.

BACKGROUND OF THE INVENTION

A fire needs three things to ignite and continue to burn—heat, fuel and an oxidizing agent, usually oxygen. A fire can be extinguished by removing any one of these three elements. In North America, cooking oil and grease fires represent about 40% of all home fires. In some areas of Europe, the figure is even higher.

Fire departments are overloaded with paramedic calls; the typical response time in North America for a fire is more than 8 minutes, during which time a cooking oil fire can do tremendous damage or spread out of control. Clearly, families need a way to extinguish a cooking oil fire on their own, quickly and safely.

Portable, chemical fire extinguishers are believed by many homeowners to be a panacea for all types of fires. Not so. Recent changes to cooking methods have brought new safety risks to the use of portable, chemical fire extinguishers. The replacement of animal fats used as cooking oils with healthier vegetable oils has reduced the ability of dry chemical fire extinguishers to effectively put out cooking oil fires. Vegetable oils have lower fatty acid content, which prevents the dry chemical's intended "foam blanket" from developing and inhibits the extinguishing agent by allowing vapors and steam to release. Additionally, vegetable oils have a much higher auto-ignition temperature than animal fats, so some newer fryers are designed to operate at higher temperatures. These 'energy-efficient' fryers retain heat much longer than previous models. Portable, dry chemical fire extinguishers have trouble preventing a re-flash from occurring in these new fryers, because of the large amount of retained heat. Heat breaks down the "foam blanket", meaning that the fire may keep self-igniting until the oil cools down.

There are several other drawbacks to the untrained homeowner attempting to put out a cooking oil fire with a portable chemical fire extinguisher:

a) There are 4 main classes of portable chemical fire extinguishers. Using the wrong kind—for example, a Class A, B, or C fire extinguisher—on a cooking oil fire, will either be ineffective or will make the situation worse, threatening the safety of the family members and risking the loss of the home. Most homeowners do not know that only Class K fire extinguishers can be used on a cooking oil fire.

b) Most homeowners do not hang their portable chemical fire extinguisher in the kitchen, because they do not feel the devices are attractive. This means the fire extinguisher will not be instantly deployable. Some homeowners may even forget where they stored their fire extinguisher, which will cause lost time in the event of a fire.

c) Portable chemical fire extinguishers need recharging. Most homeowners do not track when their fire extinguisher needs recharging. An out-of-date chemical fire extinguisher may be of no help.

d) If the homeowner should have a Class K fire extinguisher, and if he remembers where he put it and finds it quickly, and if the fire extinguisher has been appropriately recharged, there is still a huge problem—lack of training. Most homeowners purchase their fire extinguishers from mass merchants and, therefore, are not trained in the proper use of their device, especially on something as dangerous as a cooking oil fire. There is an appropriate distance that the user must stand from the fire and an appropriate place to aim the fire extinguisher. The chemical can exit the fire extinguisher nozzle with significant force. A high-powered stream aimed directly at the burning oil can cause it to splash, spreading the fire throughout the kitchen and onto the carpet. Standing too close to the burning oil while using a chemical fire extinguisher can cause life threatening burns.

e) Portable chemical fire extinguishers with plastic parts have proven to be unreliable or defective. One manufacturer recently announced the recall of 37 million fire extinguishers in the United States.

f) Portable chemical fire extinguishers have the disadvantage that, upon use, the entire kitchen will be contaminated and will require a significant, sometimes expensive, clean-up effort. Class K fire extinguishers contain saponifiers—alkaline mixtures such as potassium acetate, potassium citrate, or potassium carbonate. The alkaline mixture combines with the fatty acids in cooking oil to create a soapy foam layer on the surface of the vessel, which is intended to hold in the vapors and steam. Eventually, if the entire burning vessel has been appropriately sprayed, the fire will be extinguished. Unfortunately, the process also creates quite a mess in the kitchen.

Fire suppression blankets are used in many countries in Europe and other parts of the world to attempt to extinguish cooking oil fires, the concept being to cut off the supply of oxygen to the fire. However, fire suppression blankets also have some significant disadvantages. Current commercially available fire suppression blankets are often stored in the home, still in the manufacturer's packaging, neatly folded. This means the blanket will not be instantly deployable, which can cause lost time in the event of a fire. After the blanket is opened, simply throwing the blanket on a cooking oil fire is not a good idea. A missed throw may cause the pan to splash burning oil on the user and/or all over the kitchen, resulting in burns to the user and the fire spreading out of control. Attempting to get close enough to be able to slowly and carefully cover the fire with the blanket is not practical. A cooking oil fire is simply too hot to get sufficiently close to it. Further problems will result if a corner of the blanket lands in the cooking oil. Instead of eliminating the supply of oxygen and putting out the fire, the blanket material will act as a wick and start to burn.

United States Patent Application Publication US 2007/0158084 A1 (Schwartz) discloses a Deployable Fire Extinguishing Towel, comprising a deployable flexible frame and a fire resistant material mounted to the flexible frame for being applied on a fire for extinguishment thereof. To the frame is mounted a handle which allows the user to place the fire resistant material over the burning object, such as a pan. This Fire Extinguishing Towel has several drawbacks. The handle is rigidly mounted to the frame but, in the depicted embodiment, is too short to allow the user to remain a safe distance away from the fire. The requirement that the frame be flexible enough to change shape when placed in the storage container, is counterproductive, resulting in a device in which the flexibility of the frame does not allow the fire resistant material to create an adequately airtight seal when covering the cooking vessel. The lack of an adequate airtight seal allows the oil fire in the cooking vessel to continue to burn. The springs used for automatic deployment are under load in the storage position and therefore will gradually lose their strength or become out of round, no longer providing a flat surface to effectively cover the pan, thereby not creating an airtight seal and not cutting off the supply of oxygen and allowing the fire to continue to burn.

U.S. Pat. No. 5,842,525 (Graham) discloses a burning pan fire extinguisher where the fire extinguishing material is supported and automatically extended by folding arms which are made, for instance, of helical springs. The folding arms are attached on opposite sides of a frame which supports the folding arms and extend across the fire extinguishing material in all positions of use. From the frame extends a short handle which is made to fold for compact storage by pivoting with respect to the frame through 180 degrees. This fire extinguisher also has several drawbacks. The folding arm springs are under load in the storage position and will lose their resiliency during the long periods of time the device is typically in the storage position. This may cause a malfunction of the device during its opening into the usage position. The handle is a flat resilient plate which is difficult to handle and is too short to permit the user to remain a safe distance from the fire. The frame obstructs proper covering of the cooking vessel. The resiliency of the folding arms makes covering the cooking vessel difficult. The preferred embodiment depicts a helical spring, flexible enough to be twisted into the shape of a figure eight when put into storage. This degree of flexibility will be counterproductive when trying to put out a cooking oil fire, since the flexibility prevents sufficient downward pressure from being applied by the user to tightly cover the cooking vessel on fire.

Both Schwartz and Graham teach the use of springs that are under constant load while the devices are in storage. Neither Schwartz nor Graham has sufficiently taken into consideration the material properties of springs and the effect that gradual plastic deformation will have when the springs are under constant load for long periods of time. When purchasing a fire extinguishing device, the homeowner is purchasing a safety device that may not be needed for several years, during which time it will be in the storage position. If the spring is under constant load, that is, displaced from its equilibrium position, a very slow plastic deformation will gradually take place. This is referred to as creep when the spring under constant load loses length, ie. fails to return to its equilibrium length. When the spring under constant compression loses load, it is referred to as relaxation, ie. the spring weakens. Since the springs in both Schwartz and Graham are under constant compression in the storage position, the creep/relaxation properties of springs will cause these fire extinguishing devices to eventually fail after being in storage for a long time. In this case, unfortunately, in the event of a fire, the homeowner will simply realize that the device does not work.

SUMMARY OF THE INVENTION

The present invention solves the above problems related to the prior art by providing a collapsible cooking oil fire extinguishing device:

a) which will extinguish a cooking oil fire effectively;
b) which can be deployed easily and rapidly;
c) which can be deployed from a safe distance;
d) in which the fire resistant material will cover the burning vessel even if the vessel has a handle;
e) in which downward force can be applied by the user so that the fire resistant material will tightly cover the fire;
f) which, after deployment, will extinguish the cooking oil fire without leaving any contaminating chemical residue or requiring any significant clean-up effort;
g) in which the springs used will not be under compression while in the storage position, so that the device will perform effectively even after several years of not being used;
h) which is mounted on a wall in the kitchen in a storage container and therefore never misplaced and always instantly deployable;
i) which is attractive enough to be mounted in the kitchen in a storage container with a changeable cover imprint, mirrored face, or picture of the user's choosing, attached with Velcro or other means;
j) which requires no further training than a one-page instruction sheet.

These objectives are achieved by the present invention wherein a collapsible cooking oil fire extinguishing device has a collapsed storage position and an opened usage position and the device comprises an elongated or telescoping shaft, two rigid support arms, pliable fire resistant material attached to and supported by the rigid support arms, a manual pivot mechanism, which enables the rigid support arms to be changed between the collapsed storage position and the extended and expanded usage position, automatic locking means, which automatically locks the support arms into the usage position, and a manual release mechanism, which serves as a safety measure to prevent the accidental unlocking of the device while in the usage position.

The pivot mechanism allows the rigid support arms to be constructed of stiff material such as steel or aluminum, which serves to rigidly support the fire resistant material, allows the support arms to retain their shape when the position of the support arms is changed between the usage position and the storage position, and enables the support arms to retain their shape when the user covers the vessel containing the cooking oil fire with the fire resistant material and applies downward force onto the burning pan or vessel, subsequently resulting in the effective and rapid extinguishment of the cooking oil fire.

The pivot mechanism enables the respective position of the shaft and the rigid support arms to be changeable between the storage position and the usage position, such that the support arms and fire resistant material are located parallel to and alongside the shaft in the collapsed storage position, and at the extension of the shaft in the opened usage position. In the space-saving storage position the device does not take up much room and can be stored in a storage container which can be mounted to a wall. The device can be easily and rapidly removed from the storage container and extended and expanded into the usage position, wherein the oil fire in a cooking vessel can be tightly covered from a safe distance and extinguished.

In a preferred embodiment of the invention the locking means includes a spring, said spring being compressed only in the usage position, so as not to cause a malfunction resulting from gradual plastic deformation of the spring, or relaxation or creep of the spring during lengthy periods of time in the storage position.

Other objectives and further advantages and benefits associated with this invention will be apparent to those skilled in the art from the description, examples and claims which follow.

BRIEF DESCRIPTION OF THE DRAWINGS

The invention is illustrated in the following by way of two embodiments, referring to the attached drawings, wherein.

DETAILED DESCRIPTION OF THE PREFERRED EMBODIMENT

Figure 2:
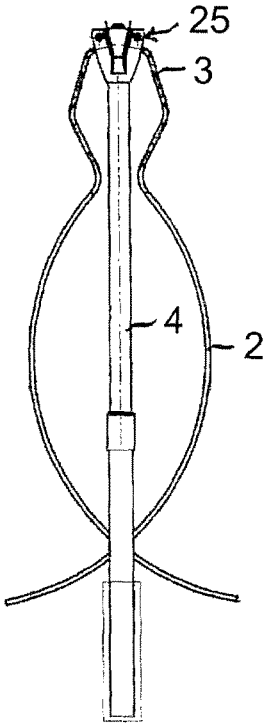
FIG. 2 shows the collapsible cooking oil fire extinguishing device according to FIG. 1, with the rigid support arms (2) depicted in the storage position.

A detailed embodiment of the instant invention is disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

The following features are common to both embodiments depicted in the figures.

The collapsible cooking oil fire extinguishing device comprises an elongated or telescoping shaft (4), two rigid support arms (2) attached to a pivot mechanism body (25; 5) at one end of the shaft, and fire resistant material (1) attached to and supported by the rigid support arms. The two rigid support arms (2) are made of stiff material, typically constructed of steel or aluminum, which will retain its shape against the forces exerted during use. The stiffness of the support arms allows the pliable fire resistant material (1), made of pliable fire resistant fabric, silicone or other pliable fire resistant material, to be pressed firmly against the edges of the cooking vessel. In the collapsed storage position, the rigid support arms (2) and fire resistant material (1) are located in a space-saving position parallel to and alongside the shaft (4). The rigid support arms (2) and the fire resistant material (1) are located at the extension of the shaft (4) in the usage position.

The rigid support arms (2) extend only partially around the perimeter of the fire resistant material (1), leaving 15-40% of the perimeter purposely unsupported. This provides two benefits:

a) The unsupported sections of the fire resistant material will cover the handles of the pan or cooking vessel in such a way that there is no interference from the rigid support arms and, with downward pressure by the user, an airtight seal can be made causing the supply of oxygen to be cut off and the fire to be extinguished;

b) The fact that the rigid support arms do not extend fully around the perimeter allows the support arms to approach each other when pivoted into a space saving storage position, and diverge from each other when pivoted into the usage position.

The pliable fire resistant material (1) is purposely slightly sagging from the rim formed by the support arms (2). The amount of sagging is preferably less than 25% of the maximum diameter of the support arms (2) in the usage position. This sagging enables the fire resistant material to be easily brought into contact with the upper edges of the pan or cooking vessel, after which downward force can be applied by the user, thereby tightly covering the cooking vessel on fire.

The diameter of the support arms (2) in the usage position is selected to be slightly greater than the diameter of the biggest cooking vessel in everyday use. Other sizes can also be manufactured to meet a user's specific requirements. The instant invention is useful in homes, restaurants and any other places where hot oil is used in cooking vessels for preparing food. Also fires of other objects such as mobile phones and other electric devices can be extinguished by the device of this invention.

The following is an explanation of the details and the differing features of the two embodiments depicted in the figures.

Figure 1:
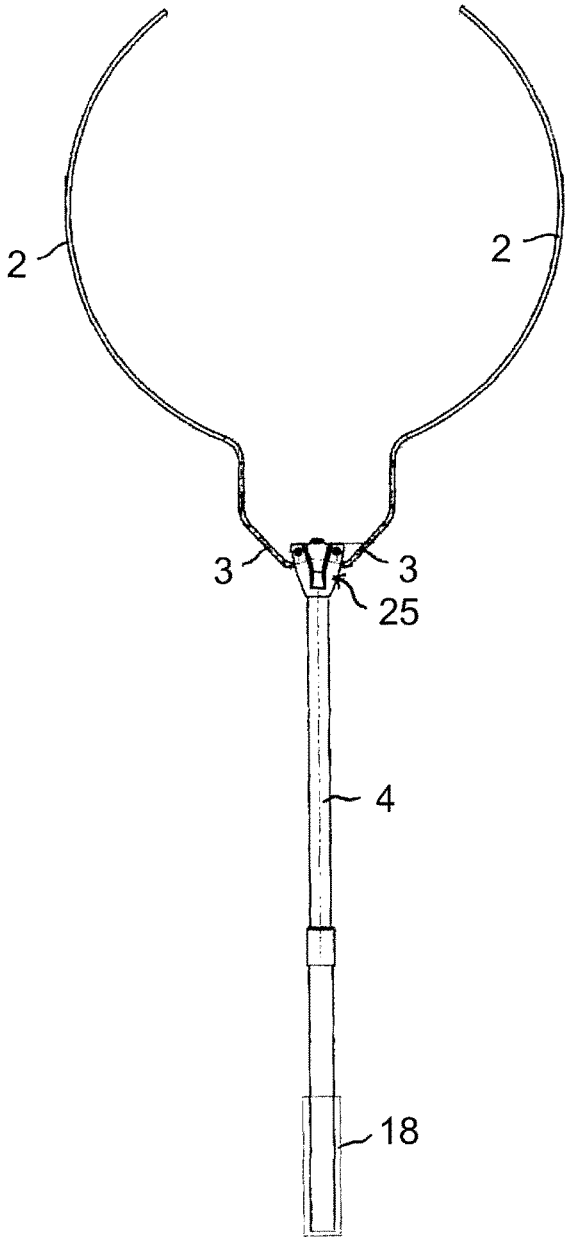
FIG. 1 shows the collapsible cooking oil fire extinguishing device according to the preferred embodiment of the invention, with the rigid support arms (2) depicted in the usage position.
Figure 3:
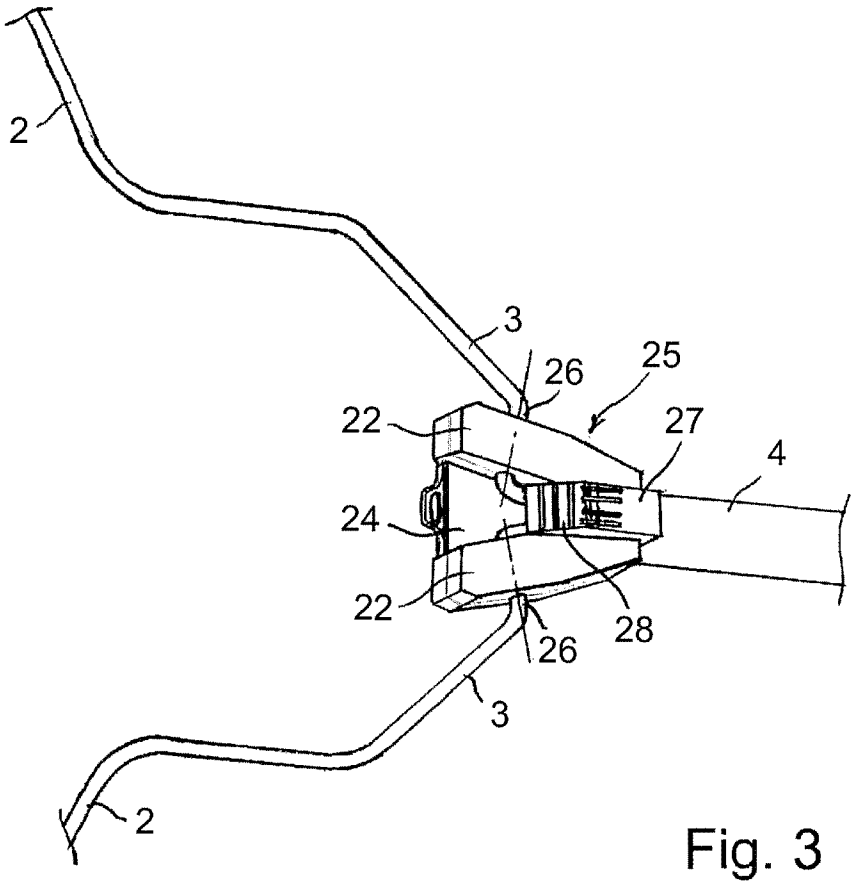
FIG. 3 shows a detail view of the collapsible cooking oil fire extinguishing device according to FIG. 1, with the rigid support arms (2) depicted in the usage position.

The preferred embodiment depicted in FIGS. 1-8 includes a pivot mechanism body (25), pivot axis (26) and locking means (23, 24, 27, 28). The pivot mechanism body (25) is divided into two body portions, namely the upper body portion (25A) and the lower body portion (25B), which are placed and fixed one on top of the other. Each body portion (25A) and (25B) comprises side blocks (22) which are at a distance from each other in a lateral direction but fixed with each other in the vertical direction. Between the side blocks (22) of the lower body portion (25B) there is a body plate (24) which is integral with the side blocks (22) of the lower body portion (25B). Each end portion (3) of the support arms (2) is bent to form a pivot axis (26) which is fitted in a pivot hole in the plane of division between each side block (22). Each end portion (3) is further bent to form a locking pin (23) at the final end of the support arm (2). The locking pins (23) are located between the side blocks (22) on the body plate (24). The body plate (24) and locking pins (23) limit the turning angle of the pivot axis (26) to be no more than 180 degrees. This enables pivoting of the support arms (2) between the storage position (FIGS. 2 and 4) and the usage position (FIGS. 1 and 3). In order to hold the support arms (2) in the usage position, there is a locking latch (27) which is mounted between the side blocks (22) and can slide against the spring force in the longitudinal direction of the shaft (4).

Figure 8:
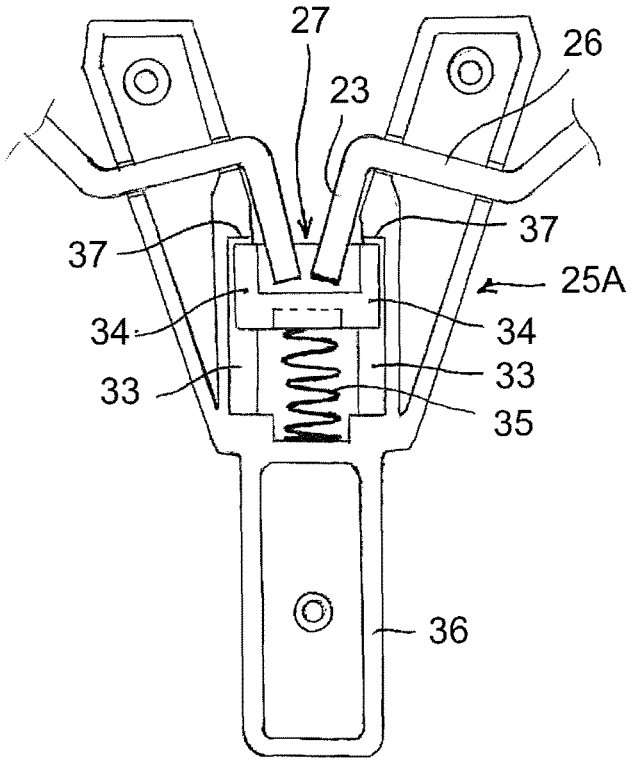
FIG. 8 shows a view of the pivot mechanism with lower body portion (25B) removed, illustrating the locking mechanism in the usage position.

FIG. 8 shows a detail view with lower body portion (25B) removed, indicating how the side flanges (34) of the locking latch (27) fit into the sliding grooves (33) of the upper body portion (25A) and the spring (35) pushes the end face of the locking latch (27) against the end faces (37) of the sliding grooves (33). FIG. 8 also shows the neck (36) used to connect the pivot mechanism body (25) to the end of the shaft. The lower body portion (25B) has a corresponding neck and which is a matching counterpart to the neck of the upper body portion (25A). The upper body portion (25A) and the lower body portion (25B), in combination, confine the locking latch (27) and the pivot axis (26) between them.

Figure 4:
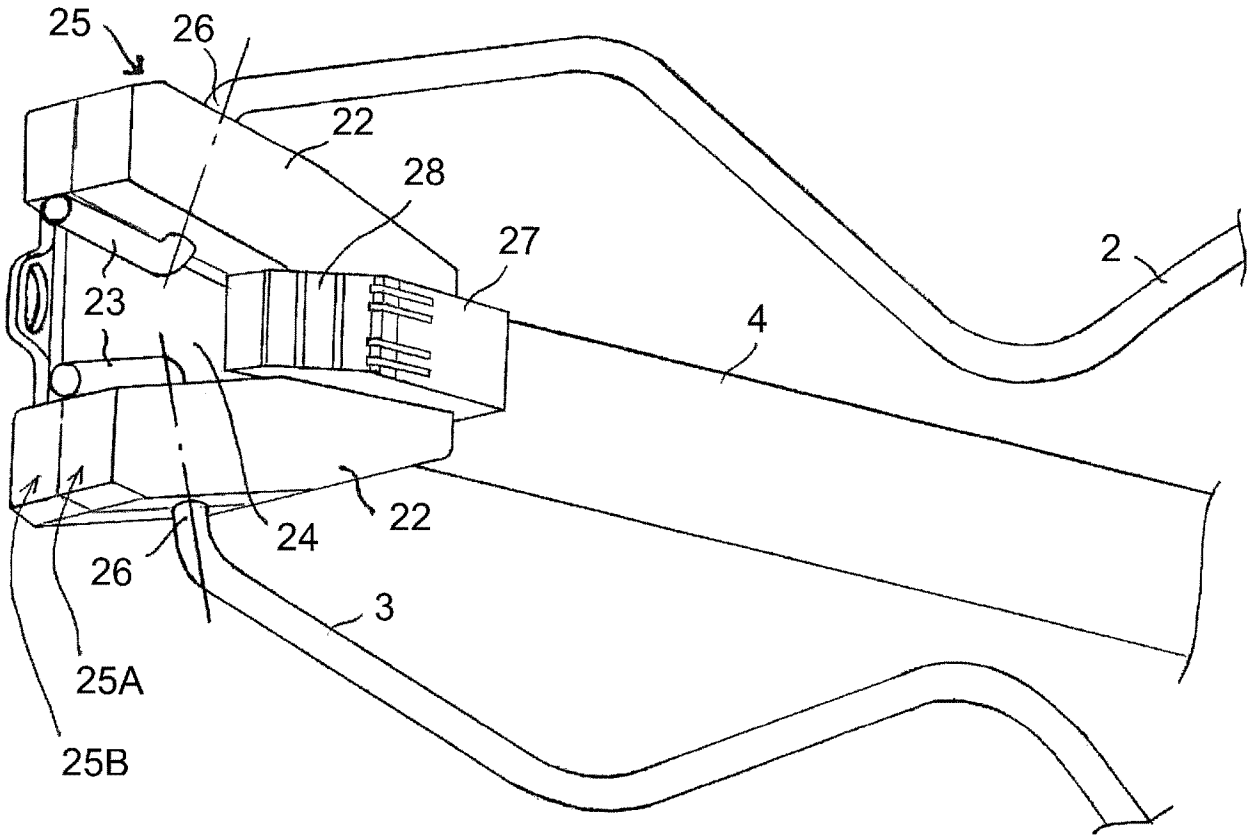
FIG. 4 shows a detail view of the collapsible cooking oil fire extinguishing device according to FIG. 2, with the rigid support arms (2) depicted in the storage position.

From FIGS. 4 and 8, one can see that when the device is opened from the storage position to the usage position, the locking pins (23) turn and press against the end face (28) of the locking latch (27), which compresses the spring (35). The spring yields against the force being exerted on it by the locking latch (27) and allows the locking latch to move towards the shaft (4).

There is sufficient space for the locking pins (23) to fit between the body plate (24) and the locking latch (27). When the locking pins (23) have completed turning the full 180 degree arc, they no longer press the locking latch (27) towards the shaft (4), and the spring (35) pushes the locking latch away from the shaft, thereby locking the rigid support arms (2) into the usage position. The locking pins (23) remain locked between the body plate (24) and the locking latch (27).

Figure 6:
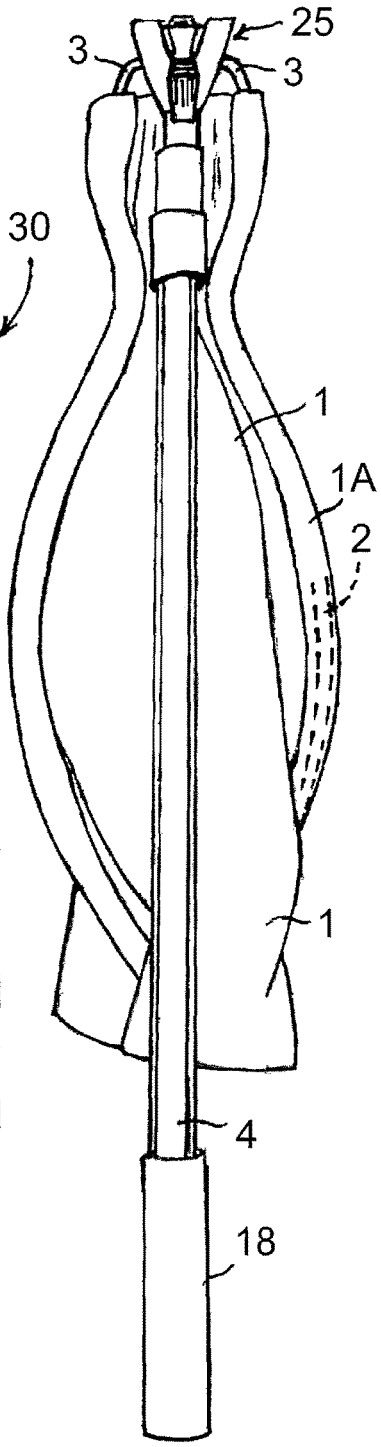
FIG. 6 shows the collapsible cooking oil fire extinguishing device according to FIGS. 1-2 in a collapsed state, in other words, in a storage position.

The user can quickly and easily extend and expand the device from the collapsed storage position into the locked usage position just by grasping the telescoping shaft (4) and swinging the device with a short upward motion. This causes the support arms (2) and the fire resistant material (1) attached to the support arms (2) to open into the usage position. At the end of the swinging motion, the locking takes place automatically, as described above. The device can be collapsed into the storage position by manually pulling the locking latch (27) towards the shaft (4) and manually folding the support arms (2) 180 degrees around the pivot axis (26), towards the shaft. When collapsed into the storage position, the support arms (2) and fire resistant material (1) attached to them are located in a space-saving position parallel to and alongside the shaft (4), as shown in FIG. 6. The fact that the device requires the above stated manual steps serves as a safety precaution, to prevent inadvertent collapse during use.

The direction of the pivot axis (26) is at an acute angle, typically of 60-85 degrees, relative to the longitudinal direction of the shaft (4). This acute angle is selected such that the free ends of the support arms (2) overlap each other in the storage position, as shown in FIG. 2, thereby minimizing the required space for the device in the storage position.

The surface of the locking latch (27) which holds the locking pins (23) in a locked position when the rigid support arms (2) are in the usage position, can be knurled or otherwise roughened, to facilitate the user gripping the locking latch with his thumb when releasing the lock, such release enabling the user to collapse the device into the storage position.

The pliable fire resistant material (1) can be attached to the rigid support arms (2) in several ways, for example, by sewing the outer edge of the fire resistant material around the rigid support arms, or by creating long, thin pockets at the outer edge of the fire resistant material, into which the rigid support arms can be inserted. FIG. 6 shows the rigid support arms (2) attached to the fire resistant material (1) by being inserted into pockets (1A) at the outer edge of the fire resistant material.

The two rigid support arms (2) can be constructed in such a way that they together allow various different shapes of fire resistant material to be used, including circular, rectangular, square or trapezoid, provided that the rigid support arms in the selected shape extend only partially around the outer edge of the fire resistant material, leaving 15-40% of the perimeter unsupported.

Figures 5A, 5B:
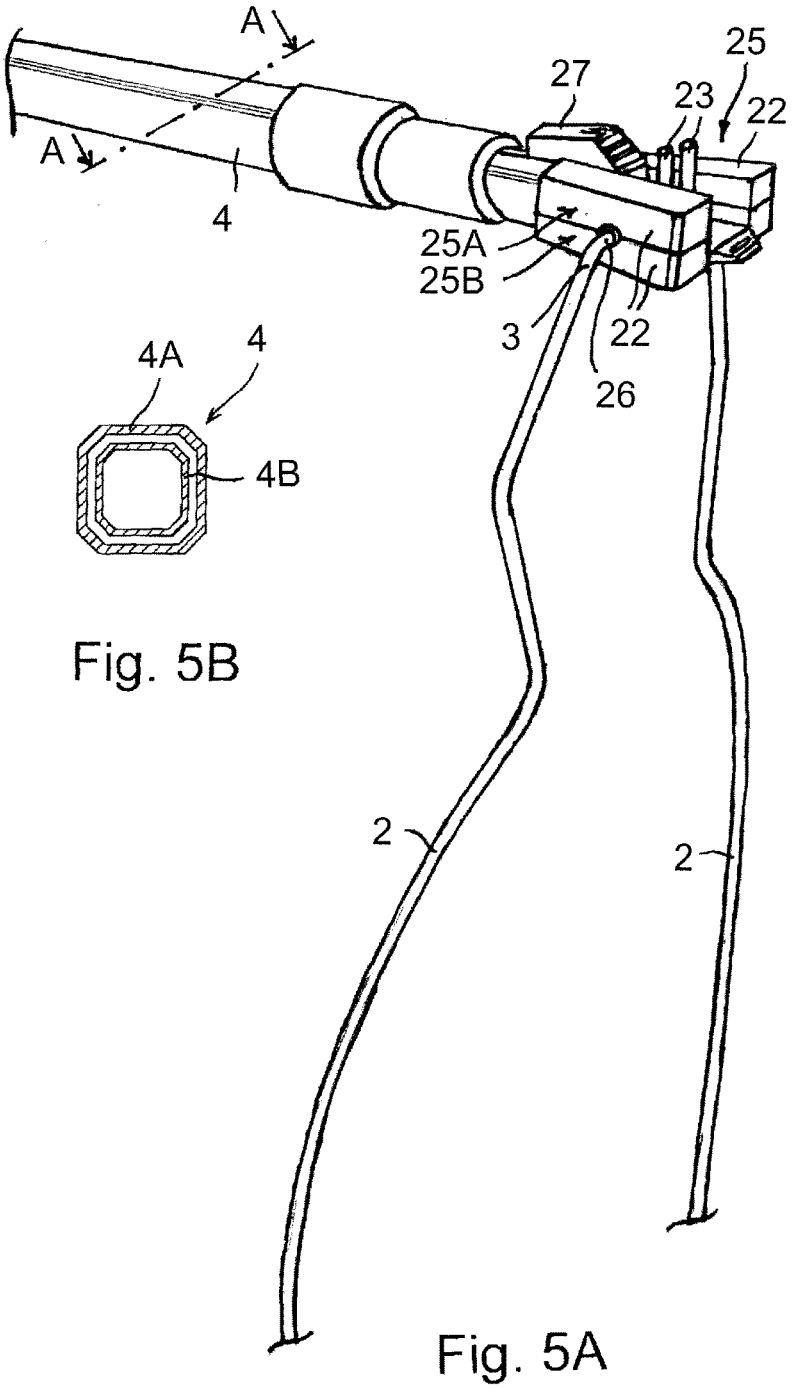
FIG. 5A shows a detail view of the collapsible cooking oil fire extinguishing device according to FIGS. 1-2 with the rigid support arms (2) pivoted into a position between the storage and usage positions.
FIG. 5B shows a cross section of the telescoping shaft (4) along line A-A in FIG. 5A.

As shown in FIGS. 5 and 5A, the shaft (4) comprises a telescoping mechanism consisting of an outer shaft portion (4A) and one or more smaller diameter shaft portions (4B) inside the outer shaft portion, enabling the working range of the device to be extended. In addition, said smaller diameter shaft portion (4B) or portions are keyed or constructed of hexagonal or other non-round material, to prevent accidental twisting of the device while in use.

Figure 7:
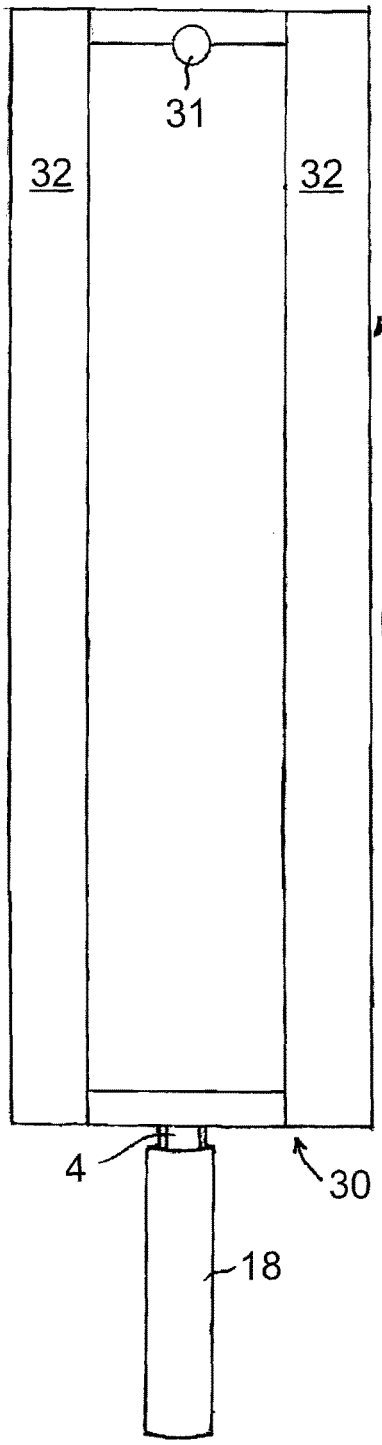
FIG. 7 shows a storage container with the collapsible cooking oil fire extinguishing device of FIG. 6 inserted therein.

As shown in FIG. 7, the collapsed device of FIG. 6 can be stored in the storage position in a storage container (30) which is provided by mounting means (31, 32) for mounting to a wall. The hole (31) allows mounting with screws or other similar fasteners. A non-marring mounting means (32) such as Velcro can also be used. The storage container (30) is preferably constructed of a material that does not allow airborne oil particles or grease to penetrate the container, ensuring that the fire resistant material does not become contaminated, and thereby ineffective, while in the storage container.

The storage container (30) is preferably constructed of a material with a smooth internal surface, so as not to impede the extraction of the device from the storage container.

The storage container (30) can be made more attractive, and therefore more likely to be mounted in the kitchen, from where it can be quickly deployed, by providing a changeable cover imprint, mirrored face, or customized picture of the user's choosing, fastened to the outside of the storage container (30) with Velcro or other means.

Figure 9:
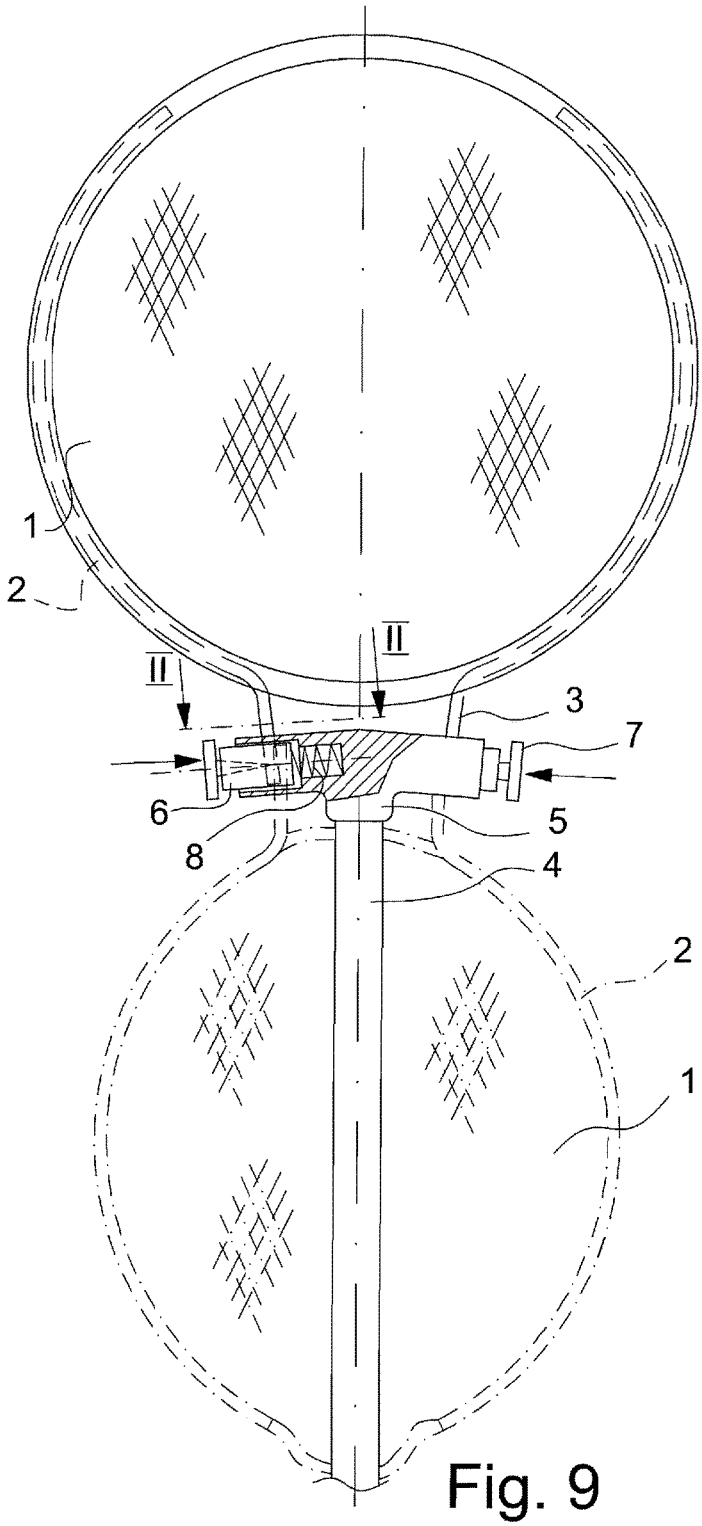
FIG. 9 shows the collapsible cooking oil fire extinguishing device according to another embodiment of the invention.
Figure 10:
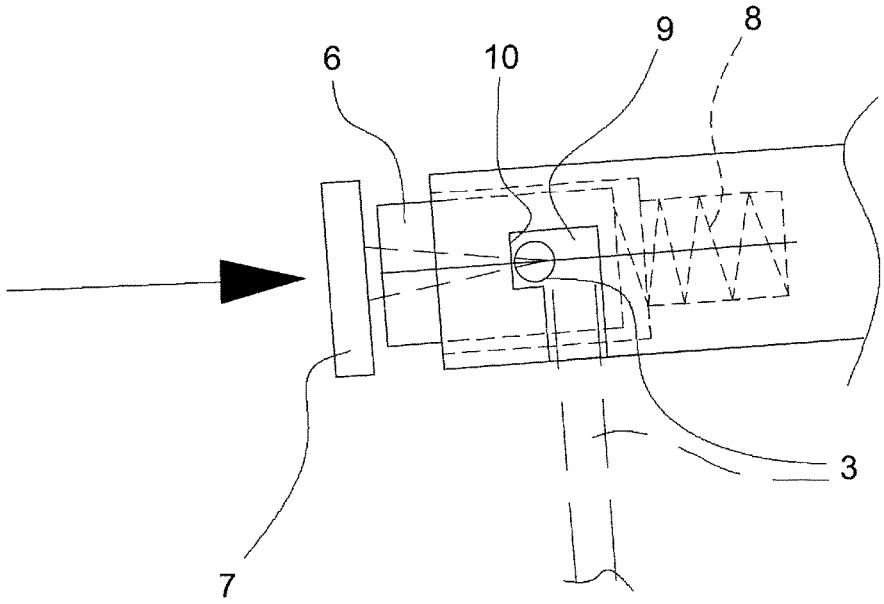
FIG. 10 shows a detail view of the collapsible cooking oil fire extinguishing device of FIG. 9 shown from the direction of line II-II on FIG. 9.

The preferred embodiment depicted in FIGS. 1-8 differs from the second embodiment, depicted in FIGS. 9 and 10, with respect to the construction of the pivot mechanism body (25; 5), pivot axis (26; 6) and the locking means (23, 24, 27, 28; 8, 9, 10).

In the second embodiment, depicted in FIGS. 9 and 10, the two rigid support arms (2) are attached to the elongated or telescoping shaft (4) by means of two pivot axis (6) which are located in a pivot mechanism body (5) at the end of the shaft. The pivot mechanism body (5) has two projections with holes, one on each side, which receive the two separate pivot axes (6) at an acute angle with respect to the axial direction of the shaft (4). The ends of the end portions (3) of the rigid support arms are pushed into the holes of the two pivot axis (6) and retained therein by means of retaining screws (7). The pivot mechanism body (5) includes a locking means (8,9,10) on each side of the pivot mechanism body (5). The locking means (8,9,10) locks the pivot axis (6) automatically by a spring biased force when the rigid support arms (2) are pivoted into the usage position. For that purpose each locking means comprises a slot (9) in the body (5). Each slot (9) receives the end portion (3) of the support arm (2) such that the support arms (2) can be pivoted 180 degrees between the usage and storage positions. For locking the support arms (2) into the usage position, the slot (9) has a groove (10) which receives the end portion (3) of the support arm when the spring (8) urges the pivot axis (6) outwards from the projection of the body (5). When the end portions (3) of the support arms are received in the grooves (10), the support arms are locked in the usage position. Locking can be released by manually pressing the pivot axis (6) inwards (see the arrows in FIGS. 9 and 10) causing the end portions (3) to be released from the grooves (10), following which the support arms (2) can be pivoted 180 degrees into the storage position. Simultaneously the support arms (2) approach each other because of the acute angle of the pivot axis (6) relative to the direction of the shaft (4), reducing the required storage space. The shaft (4) is telescopically extendable. The minimum length of the shaft (4) is 80 cm which is at least double the diameter of the support arms in the usage position. Preferably the length is more than 100 cm, typically about 120 cm. The angle of inclination of the pivot axis (6) is selected according to the desired degree of collapsing of the support arms (2) in the storage position. The pivot axis is typically at an acute angle of 60-85 degrees relative to the longitudinal direction of the shaft. The direction of each groove (9) is perpendicular to the direction of each corresponding pivot axis (6).

In both embodiments presented, the elongated or telescoping shaft (4) can be extended and the support arms (2) can be pivoted to the usage position, whereby the user can cover the cooking oil fire with the fire resistant material (1) from a safe distance.

It is an important feature of both embodiments of the instant invention that the spring (35; 8) is not in compression during the long periods of time when the device is expected to be in the storage position. This minimizes the possibility of a malfunction resulting from spring creep or relaxation. This feature is of utmost importance to the reliability and longevity of this potentially life-saving device.

The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or." The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A collapsible cooking oil fire extinguishing device having a collapsed storage position and an opened usage position, the device comprising: a shaft (4) having a manual pivot mechanism formed from a pivot mechanism body (25; 5) with an automatic locking means (23, 24, 27, 28; 8, 9, 10) including a spring (35; 8), said pivot mechanism functioning so that said spring (35; 8) is not in compression when the device is in the storage position, and functioning so that the device cannot be opened from the storage position but must be manually opened from the storage position and pivoted into the usage position by compressing said spring (35; 8), said spring (35; 8) providing stiffness to the manual pivot mechanism in the usage position, following which said automatic locking means (23, 24, 27, 28; 8, 9, 10) locks the device into the usage position, the device further comprising pliable fire resistant material for securement to rigid support arms (2) attached at a proximal end to said manual pivot mechanism with a distal end of said rigid support arms (2) extending partially around the circumference of said fire resistant material (1), such that a portion of said fire resistant material (1) is intentionally left unsupported, the automatic locking means (23, 24, 27, 28; 8, 9, 10) further comprising a manual release activation mechanism such that, when activated, allows the rigid support arms (2) to pivot, together with the fire resistant material (1), into the storage position, simultaneously releasing the spring (35; 8) from its compressed state into its equilibrium state.

2. The collapsible cooking oil fire extinguishing device according to claim 1, wherein said rigid support arms are attached to said pivot mechanism body (25; 5) in such a way that the end of each said rigid support arm goes through a hole penetrating said pivot mechanism body, said holes serving as pivot axes (26; 6) for said rigid support arms in said pivot mechanism body which is attached to one end of the shaft (4), and said pivot axes being oriented at an acute angle of 60-85 degrees relative to the longitudinal direction of the shaft.

3. The collapsible cooking oil fire extinguishing device according to claim 1, wherein said automatic locking means comprises the end portions (3) of said rigid support arms (2), which penetrate the holes in said pivot mechanism body (25) and are bent to serve as pivot axes (26), said end portions (3) further including final ends which are further bent to serve as locking pins (23), said automatic locking means further including the spring (35), a locking latch (27), and an end face (28) of the locking latch, such locking latch being held in the locked position by the spring (35) and confining the locking pins (23) in a locked position against a body plate (24), when the rigid support arms (2) have been manually pivoted from the storage position into the usage position.

4. The collapsible cooking oil fire extinguishing device according to claim 3, wherein said locking latch (27) which holds the locking pins (23) in a locked position when said rigid support arms are in the usage position, is knurled or the surface is otherwise roughened, to facilitate the user gripping said locking latch wherein the user employs a thumb when releasing the locking means enabling the user to collapse the device into the storage position.

5. The collapsible cooking oil fire extinguishing device according to claim 1, wherein said spring is compressed only in the usage position, so as not to cause a malfunction resulting from creep or relaxation of the spring during lengthy periods of time in the storage position.

6. The collapsible cooking oil fire extinguishing device according to claim 1, wherein the manual release of the locking means, requiring manual movement of a locking latch (27) against the force of the spring (35; 8), serves as a safety measure to prevent the accidental or unintentional collapse of the device while in the usage position.

7. The collapsible cooking oil fire extinguishing device according to claim 1, wherein said rigid support arms are made of stiff material whereby the support arms retain their shape when downward force is exerted by the user on a cooking vessel or other object on fire, and when the positions of the support arms are changed between the usage position and the storage position.

8. The collapsible cooking oil fire extinguishing device according to claim 1, wherein the user can extend and expand the device from the collapsed storage position into the locked usage position just by grasping said shaft (4) and swinging the device with an upward motion.

9. The collapsible cooking oil fire extinguishing device according to claim 1, wherein said rigid support arms (2) serve to support the fire resistant material (1), said rigid support arms being attached to said fire resistant material by being inserted into pockets at the outer edge of the fire resistant material.

10. The collapsible cooking oil fire extinguishing device according to claim 1, wherein said rigid support arms are attached to said fire resistant material by sewing the outer edge of the fire resistant material around the rigid support arms.

11. The collapsible cooking oil fire extinguishing device according to claim 1, wherein said rigid support arms extend only partially around the outer edge of the fire resistant material, leaving 15-40% of the perimeter unsupported.

12. The collapsible cooking oil fire extinguishing device according to claim 1, wherein said rigid support arms (2) can be constructed in such a way that they together allow various different shapes of fire resistant material to be used, including circular, oval, rectangular, square or trapezoid, provided that the rigid support arms in the selected shape extend only partially around the outer edge of the fire resistant material, leaving 15-40% of the perimeter unsupported.

13. The collapsible cooking oil fire extinguishing device according to claim 1, wherein the fire resistant material is sagging from the rigid support arms, the amount of sagging being less than 25% of the maximum diameter between the rigid support arms (2) in the usage position.

14. The collapsible cooking oil fire extinguishing device according to claim 1, wherein the shaft (4) comprises a telescoping mechanism consisting of an outer shaft portion (4A) and one or more smaller diameter shaft portions (4B) inside the outer shaft portion, enabling the working range of the device to be extended, and further said smaller diameter shaft portion or portions being keyed or constructed of hexagonal or other non-round material, to prevent accidental twisting of the device while in use.

15. The collapsible cooking oil fire extinguishing device according to claim 1, wherein said rigid support arms (2) are shaped so as to approach each other when being collapsed, and diverge from each other when being opened into the usage position, minimizing the required storage space when placed into a storage container.

16. The collapsible cooking oil fire extinguishing device according to claim 1, wherein the device is stored in the storage position in a storage container (30) which is provided by mounting means (31, 32) for mounting to a wall with screws or fasteners, or by a non-marring mounting means (32) such as Velcro.

17. The collapsible cooking oil fire extinguishing device according to claim 16, wherein the storage container (30) is constructed of a material that does not allow airborne oil particles or grease to penetrate the container, ensuring that the fire resistant material does not become contaminated and thereby ineffective, while in the storage container.

18. The collapsible cooking oil fire extinguishing device according to claim 16, wherein the storage container (30) is constructed of a material with a smooth internal surface, so as not to impede the extraction of the device.

19. The collapsible cooking oil fire extinguishing device according to claim 16, wherein the device can be mounted in the kitchen in a location from which it can be quickly deployed, in said storage container (30) having a changeable cover imprint, mirrored face, or customized picture of the user's choosing, fastened to the storage container by Velcro or other means.

* * * * *